US005182827A

United States Patent [19]

Carrier et al.

[11] Patent Number: 5,182,827

[45] Date of Patent: Feb. 2, 1993

[54] SHEET-MATTRESS RETAINER

[76] Inventors: Odie R. Carrier, 425 Eissler Rd., Evansville, Ind. 47711; Steven C. Pike, 317 E. Mill Rd., Evansville, Ind. 47714

[21] Appl. No.: 785,536

[22] Filed: Oct. 31, 1991

[51] Int. Cl.[5] ..... A47C 21/02

[52] U.S. Cl. ..... 5/498; 5/460; 24/72.5; 24/462

[58] Field of Search ..... 5/460, 498; 24/462, 24/72.5

[56] References Cited

U.S. PATENT DOCUMENTS

| | | | |
|---|---|---|---|
| 2,149,970 | 3/1939 | Liebmann | 24/72.5 |
| 2,149,971 | 3/1939 | Liebmann | 24/72.5 |
| 2,195,967 | 4/1940 | Liebmann | 24/72.5 |
| 2,225,875 | 12/1940 | Liebmann | 24/72.5 |
| 3,045,310 | 7/1962 | Velinsky | 24/72.5 X |
| 3,141,221 | 7/1964 | Faulls, Jr. | 24/462 |
| 5,016,306 | 3/1991 | Grisna | 24/72.5 X |
| 5,095,591 | 3/1992 | Hubscher | 5/498 X |

OTHER PUBLICATIONS

Advertisement by "Den/Mar Ltd." in Jul. 1985 issue of Bedding Magazine.

*Primary Examiner*—Michael F. Trettel

[57] ABSTRACT

A sheet-mattress retainer particularizing by usage, in a retaining relationship, between a sheet and the taped edge or binding along the edges of a customary mattress. The retainers, used in pairs, face each other on opposite side walls of the mattress and are readily positioned and released due to the resilient properties of such. Since no teeth form part of the finished unit, any puncturing and/or fabric damage is precluded.

3 Claims, 1 Drawing Sheet

SHEET-MATTRESS RETAINER

BACKGROUND OF THE INVENTION

As is known, the maintaining of sheets in place on a common bed mattress requires continual attention on the part of the user/homemaker, since, ordinarily, the bed sheets tend to bunch, creating a "bumpy" effect even when disposed beneath a bedspread. In other words, smoothing is a necessity for a proper finished appearance.

DESCRIPTION OF THE INVENTION

In order to expedite time and, also, to accomplish the desired end result, the invention presents a sheet-mattress retainer, or what might also be identified as a "sheet keeper," generally used in opposing pairs, i.e. on opposite side walls of the mattress on which the sheet is placed, whereby the sheet is secured in position by affixing each of the sheet-mattress retainers to the binding or taped edges of the mattress covering. The preceding encompasses the binding or taped edges of various types of mattresses, as, for example, innerspring, foam or soft side (hybrid), or, any surface which employs binding tape edges.

Typically, the sheet-mattress retainers are each disposed proximate the corners of the mattress, where they are readily positioned in a sheet securing location, each being of a configuration which precludes cutting or tearing of the sheet, as when metal claws or clamps with teeth are used to clamp and/or position the sheet. The sheet-mattress retainers are readily fabricated, being typically molded from an ABS plastic resin.

DESCRIPTION OF THE FIGURES

In any event, a better understanding of the present invention will become more apparent from the following description, taken in conjunction with the accompanying drawing, wherein.

Figure 1:
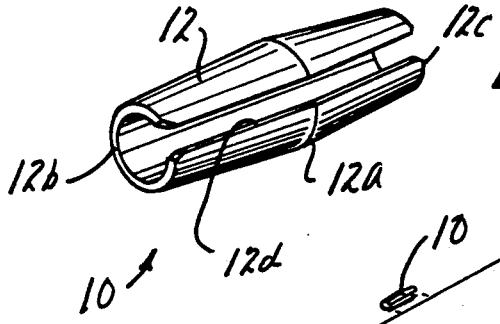
FIG. 1 is a perspective view of a sheet-mattress retainer in accordance with the teachings of the present invention.

For the purposes of promoting an understanding of the principles of the invention, reference will now be made to the embodiment illustrated in the drawing and specific language will be used to describe the same. It will nevertheless be understood that no limitations of the scope of the invention is thereby intended, such alterations and further applications of the principles of the invention as illustrated therein being contemplated as would normally occur to one skilled in the art to which the invention relates.

DESCRIPTION OF THE PREFERRED EMBODIMENT

Figure 4:
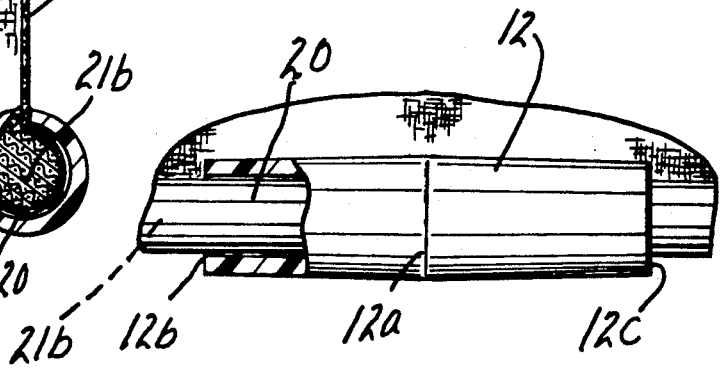

Referring now to the figures, the sheet-mattress retainer 10 of the invention is detailed in FIGS. 1 and 4, being molded from a plastic resin, and presenting a body portion 12 angling slightly inwardly from the mid-area 12*a* to each end 12*b*,12*c*. The body portion 12 is hollow and includes a longitudinal receiving slot 12*d* (again see FIG. 1).

Figure 2:
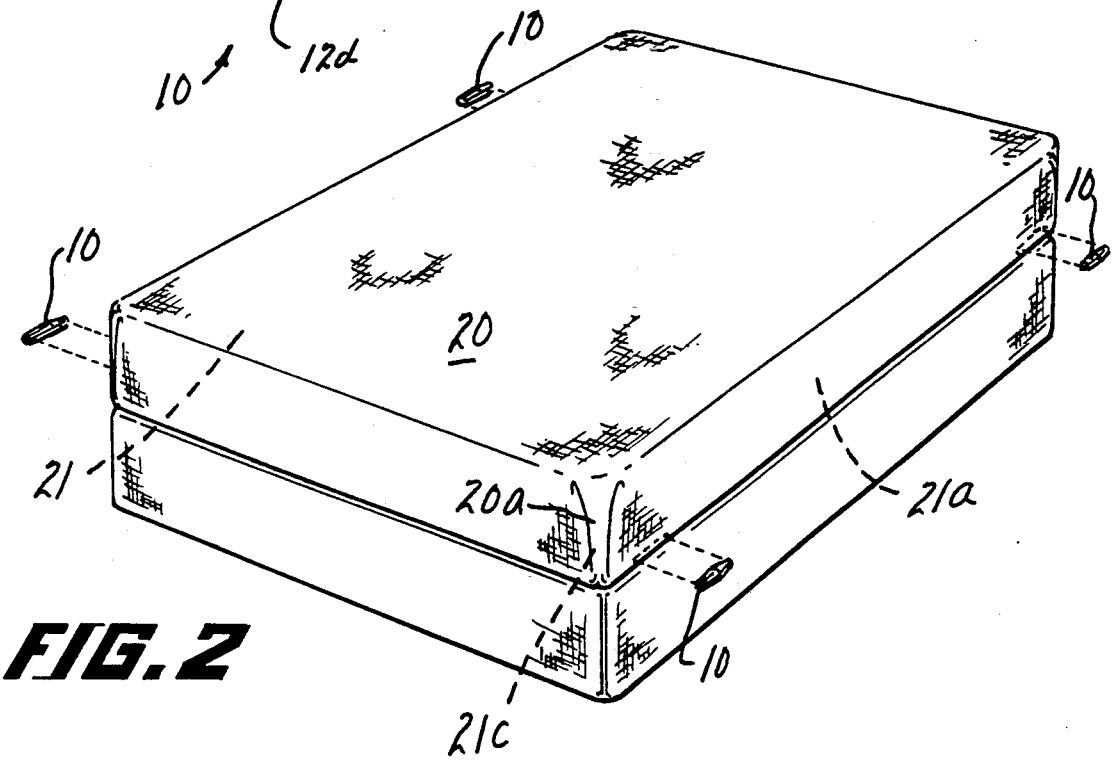
FIG. 2 is a perspective view of a sheet covered mattress, where the ultimate use positioning location of each retainer is designated by broken lines.
Figure 3:
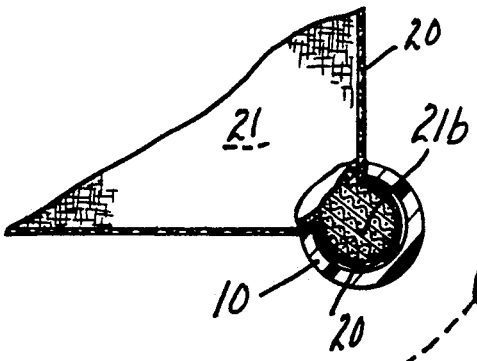
FIG. 3 is a view in vertical section detailing the instant sheet-mattress retainer at a use location; and, FIG. 4 is a view in front elevation further detailing the use of the invention on the binding or taped edge of the mattress.

In a use condition, and as illustrated in FIG. 3, a sheet 20 overlays mattress 21 and, typically, includes mitered corners 20*a*. The sheet-mattress retainers 10 are typically located in an opposing and facing relationship on side walls 21*a* of the mattress 21 (see FIG. 2) and are each forced over the sheet 20 and into a retained relationship with the mattress binding or taped edge 21*b* (again see FIG. 3).

Thus, the instant sheet-mattress retainer 10 is readily secured and/or detached from an operating location and, preferably, adjacent the corners 21*c* of the mattress 21 to assure proper unruffled sheet 20 placement. Importance lies in the fact that no sheet damage should be occasioned, as when a toothed retainer or clamp is involved and, moreover, since mattress binding tape is a common denominator to virtually most mattresses.

The sheet securement/release is assured by reason of the slightly and/or controlled flexible properties of the sheet-mattress retainer 10. Moreover, the straight edges defining the receiving slot 12*d* eliminates the "toothed" effect noted above with respect to prior devices.

The sheet-mattress retainer arrangement described hereabove is susceptible to various changes within the spirit of the invention including, by way of example, proportioning; material selection; color keying to satisfy a particular decorating environment; and, the like. Thus, the preceding should be considered illustrative and not as limiting the scope of the following claims:

We claim:

1. An arrangement for retaining a sheet onto a mattress including binding tape along edges thereof comprising retainers each having a body including a mid-region, ends, a longitudinal opening therethrough and a longitudinal slot disposed along a wall of said opening, where said body tapers inwardly from said mid-region thereof towards each of said ends, and where said longitudinal opening receives said binding tape edge of said mattresses and said sheet and the configuration of said body serves to maintain said retainers in a fixed position.

2. The arrangement of claim 1 where said retainers are disposed on opposite side walls of said mattress and in facing pairs.

3. The arrangement of claim 1 where said retainers are each disposed proximate a corner of said mattress.

* * * * *